US008487550B2

(12) United States Patent
Zhang et al.

(10) Patent No.: US 8,487,550 B2
(45) Date of Patent: Jul. 16, 2013

(54) MULTI-CHANNEL LED DRIVER CIRCUIT

(75) Inventors: Weiqiang Zhang, Shanghai (CN); Lizhi Xu, Shanghai (CN); Qi Zhang, Shanghai (CN); Jianping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 127 days.

(21) Appl. No.: 13/297,460

(22) Filed: Nov. 16, 2011

(65) Prior Publication Data

US 2013/0043808 A1 Feb. 21, 2013

(30) Foreign Application Priority Data

Aug. 19, 2011 (CN) ..... 2011 1 0238134

(51) Int. Cl.
*H05B 37/02* (2006.01)

(52) U.S. Cl.
USPC ..... 315/297; 315/177; 315/294

(58) Field of Classification Search
USPC ..... 315/177, 185 R, 209 R, 291, 294, 315/297, 299, 307
See application file for complete search history.

(56) References Cited

U.S. PATENT DOCUMENTS

| | | | | |
|---|---|---|---|---|
| 6,297,601 | B1 * | 10/2001 | Kang | 315/387 |
| 2010/0001661 | A1 * | 1/2010 | Huang et al. | 315/294 |
| 2011/0260645 | A1 * | 10/2011 | Chen et al. | 315/294 |
| 2012/0025725 | A1 * | 2/2012 | Kimura | 315/201 |
| 2012/0061236 | A1 * | 3/2012 | Kiontke | 204/192.34 |
| 2012/0104968 | A1 * | 5/2012 | Shiu et al. | 315/291 |
| 2012/0112646 | A1 * | 5/2012 | Shiu et al. | 315/186 |
| 2012/0169245 | A1 * | 7/2012 | Chen | 315/223 |
| 2012/0299483 | A1 * | 11/2012 | Lethellier | 315/121 |
| 2013/0113375 | A1 * | 5/2013 | Leung et al. | 315/85 |

* cited by examiner

*Primary Examiner* — Don Le
(74) *Attorney, Agent, or Firm* — Kirton McConkie; Evan R. Witt

(57) ABSTRACT

Provided is a multi-channel LED driver circuit, including a power supply device for providing an independent voltage source; a plurality of regulating circuits connected to the power supply device and the light light-emitting diode arrays for receiving a voltage from the voltage source and providing a plurality of output currents to the light-emitting diode arrays, and thereby generating a plurality of error signals.

22 Claims, 4 Drawing Sheets

MULTI-CHANNEL LED DRIVER CIRCUIT

FIELD OF THE INVENTION

The invention relates to a driver circuit, and more particularly to a multi-channel light-emitting diode (LED) driver circuit capable of driving a plurality of LED arrays.

BACKGROUND OF THE INVENTION

With the breakthrough of the manufacturing technique of the light-emitting diode (LED) in recent years, the luminance and illuminating efficiency of the light-emitting diode are greatly enhanced. Therefore, the light-emitting diode has replaced the fluorescent lamps as the illuminating elements of the next generation. Also, the light-emitting diode has been widely used as a car illuminating device, handheld illuminating device, the backlight source of liquid crystal display (LCD) panels, the traffic signs, and billboards.

It is generally required to drive a plurality of light-emitting diode arrays to provide sufficient light source in LED-related applications. As each light-emitting diode has different characteristics with each other, the currents flowing through the light-emitting diode arrays are unequal with each other. Thus, the luminance of the electronic device employing light-emitting diodes, such as a LCD panel, is not uniform. This would shorten the life of the light-emitting diodes and damage the electronic device.

To address the problem as a result of the unbalanced currents flowing through the light-emitting diode arrays, various current balancing technique for light-emitting diode has been proposed to address this problem. FIG. 1 is a block diagram showing the structure of a conventional multi-channel LED driver circuit. As shown in FIG. 1, the conventional multi-channel LED driver circuit 1 is used to drive a plurality of LED arrays G1-G4. The multi-channel LED driver circuit 1 includes a transformer Tr, a pulse-width modulation (PWM) controller 11, a main switch 12, an output rectifier and filter 13, and a plurality of regulating circuits 14-15. The primary winding Np of the transformer Tr is connected to the main switch 12, and the secondary windings Ns1-Ns4 of the transformer Tr are connected to the output rectifier and filter 13 and the regulating circuits 14-15. The pulse-width modulation (PWM) controller 11 is connected between the control terminal of the main switch 12 and the output rectifier and filter 13.

In operation, the energy of the input voltage Vin is transmitted to the primary winding Np through the main switch 12 by the switching operations of the main switch 12. Thus, each secondary winding Ns1 -Ns4 can generate a secondary voltage and provide the secondary voltage for the output rectifier and filter 13 and the regulating circuits 14-15. The currents provided for the light-emitting diode arrays are balanced by the operations of the output rectifier and filter 13 and the regulating circuits 14-15. Therefore, the current-equaling performance is attained. In order to allow each secondary winding Ns1-Ns4 to provide sufficient power for the output rectifier and filter 13 and the regulating circuits 14-15, the pulse-width modulation (PWM) controller 11 can regulate the duty ratio of the main switch 12 according to the output current of the output rectifier and filter 13.

It can be known from the above descriptions that the conventional multi-channel light-emitting diode (LED) driver requires a transformer with a plurality of secondary windings and a complex structure. Thus, the conventional multi-channel light-emitting diode (LED) driver is costly and bulky. Also, as the output rectifier and filter and the regulating circuits are independent from each other, the pulse-width modulation (PWM) controller can regulate the duty ratio of the main switch according to the output current of the output rectifier and filter 13. However, in order to allow each secondary winding Ns1-Ns4 to provide sufficient power for the output rectifier and filter 13 and the regulating circuits 14-15, the regulation of the duty ratio can not be optimized. Thus, the power provided by the secondary winding for the regulating circuit will be excessive, which indicates that the secondary voltage provided by secondary winding has a larger duty ratio. This would cause a considerable power loss to the regulating circuit and the multi-channel light-emitting diode (LED) driver and deteriorate the operating efficiency of the multi-channel light-emitting diode (LED) driver.

It is incline to develop a multi-channel light-emitting diode (LED) driver to address the aforementioned problems encountered by the prior art.

SUMMARY OF THE INVENTION

An object of the invention is to provide a multi-channel LED driver circuit using a transformer with a single secondary winding and a simplified structure for reducing cost and size. Also, with the feedback signal provided by the determining circuit, the main control unit can regulate the duty ratio of the main switch circuit according to the operating status of each regulating circuit, thereby optimizing the duty ratio of the main switch circuit. In this manner, the power provided by the secondary winding for the regulating circuit is normal and the power loss is reduced, and thus the operating efficiency is improved.

To this end, the invention provided a multi-channel light-emitting diode driver circuit for driving a plurality of light-emitting diode arrays. The inventive multi-channel light-emitting diode driver circuit includes a transformer having a primary winding and a secondary winding; a main switch circuit connected to the primary winding for allowing an input voltage to be transmitted to the secondary winding and generating a secondary voltage across the secondary winding by the switching operations of the main switch circuit; a plurality of regulating circuits connected to the secondary winding and the light-emitting diode arrays for receiving the secondary voltage and providing a plurality of output currents to the light-emitting diode arrays to generate a plurality of error signals; a determining circuit connected to the regulating circuits for receiving the error signals individually indicative of a power through rate of each regulating circuit and generating a feedback signal according to the power through rate indicated by the error signals; and a main control unit connected to a control terminal of the main switch circuit and the determining circuit for generating a switching control signal to control the switching operations of the main switch circuit.

Another aspect of the invention is attained by the provision of a multi-channel light-emitting diode driver circuit for driving a plurality of light-emitting diode arrays. The inventive multi-channel light-emitting diode driver circuit includes a power supply device for providing an independent voltage source; and a plurality of regulating circuits connected to the power supply device and the light light-emitting diode arrays for receiving a voltage from the voltage source and providing a plurality of output currents to the light-emitting diode arrays, and thereby generating a plurality of error signals.

Now the foregoing and other features and advantages of the invention will be best understood through the following descriptions with reference to the accompanying drawings, in which:

DESCRIPTION OF THE PREFERRED EMBODIMENT

An exemplary embodiment embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

The invention provides a multi-channel LED driver circuit for driving a plurality of LED arrays (or LED strings). The number of the channels and the number of the light-emitting diodes in each array is variable depending on user's demands. Next, the invention will be described in detail by giving an exemplary embodiment of a multi-channel LED driver circuit for driving a three-array LED circuit, in which each LED array is consisted of four light-emitting diodes.

Figure 1:
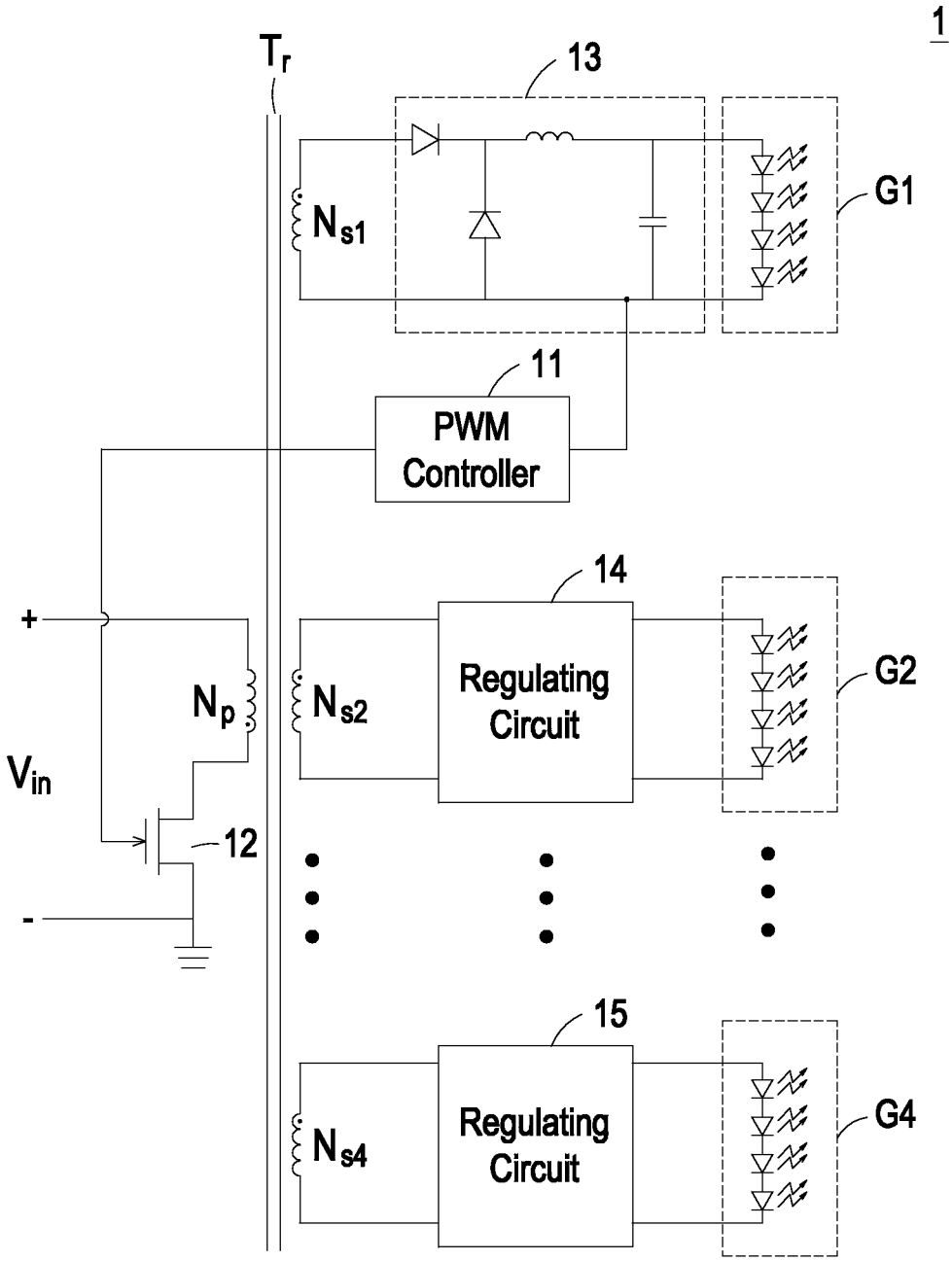
FIG. 1 PRIOR ART
FIG. 1 shows the structure of a conventional multi-channel LED driver circuit.
Figure 2A:
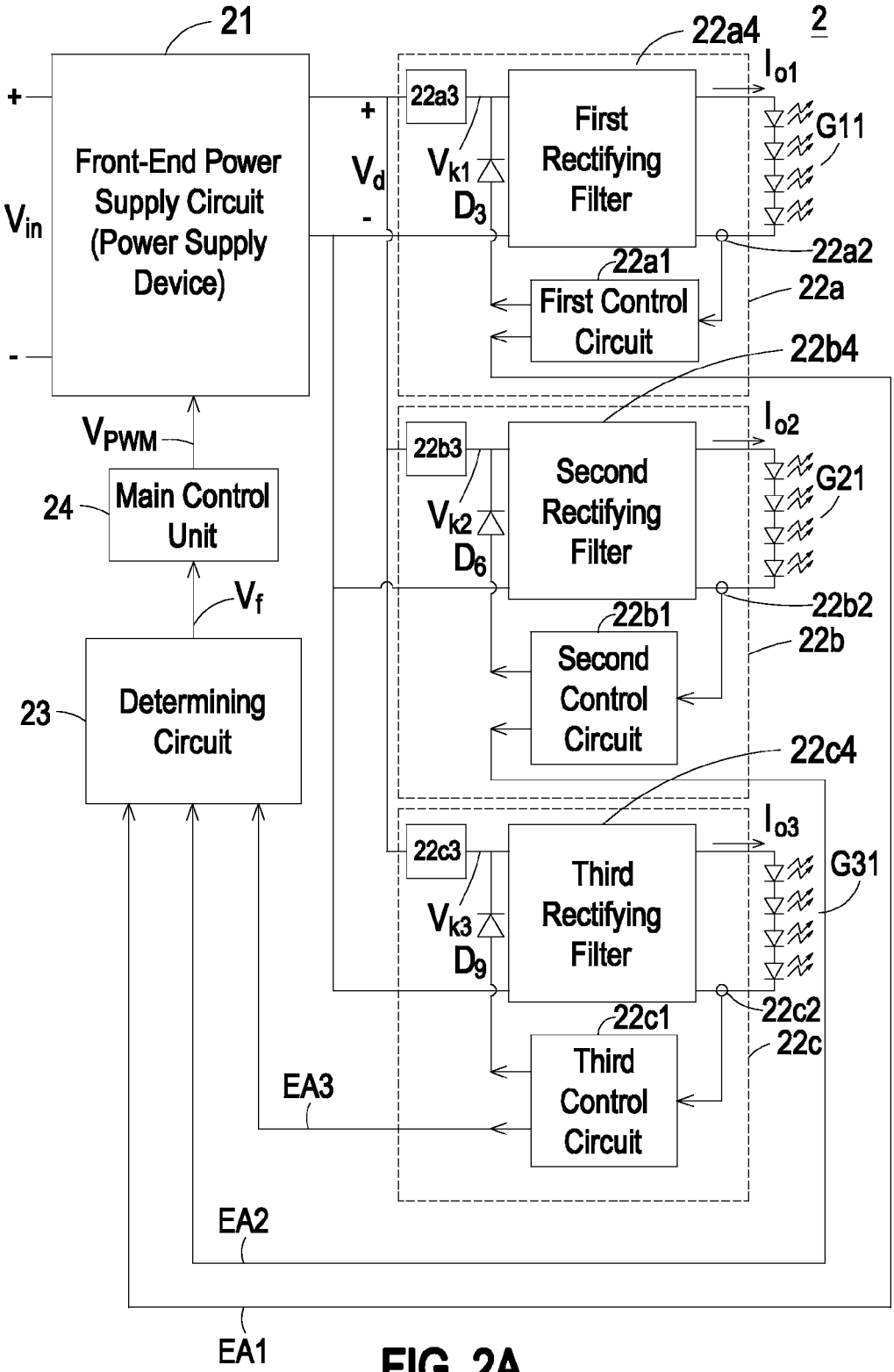
FIG. 2A is a block diagram showing the structure of a multi-channel LED driver circuit according to an exemplary embodiment of the invention.

FIG. 2A is a block diagram showing the structure of a multi-channel LED driver circuit according to an exemplary embodiment of the invention. As shown in FIG. 2A, the inventive multi-channel LED driver circuit 2 includes a front-end power supply circuit 21, regulating circuits 22*a*-22*c*, a determining circuit 23, and a main control unit 24. The power input side of the front-end power supply circuit 21 is configured to receive an input voltage Vin, and the power output side of the front-end power supply circuit 21 is connected to the input sides of the regulating circuits 22*a*-22*c*. The output sides of the regulating circuits 22*a*-22*c* are respectively connected to the light-emitting diode arrays G11-G31. The determining circuit 23 is connected between the regulating circuits 22*a*-22*c* and the main control unit 24. The main control unit 24 is connected to the determining circuit 23 and the control terminal of the front-end power supply circuit 21.

In operation, the main control unit 24 will control the main switch circuit of the front-end power supply circuit 21 (not shown) to drive the front-end power supply circuit 21 to convert the input voltage Vin into a secondary voltage Vd. The front-end power supply circuit 21 can only provide a variable secondary voltage Vd to the input sides of the regulating circuits 22*a*-22*c*, and balance the output currents Io1-Io3 provided to the light-emitting diode arrays G11-G31 by the operations of the regulating circuit 22*a*-22*c*, thereby attaining the current-equaling performance. The front-end power supply circuit 21 can be implemented by a power supply device. Therefore, a single secondary voltage Vd that serves as an independent voltage source and whose voltage value is variable between a high voltage level and a low voltage level is provided.

In this embodiment, the first regulating circuit 22*a* includes a third diode D3, a first control circuit 221*a*, a first current detecting circuit 22*a*2, a first balancing unit 22*a*3, and a first rectifier and filter 22*a*4. The balancing unit 22*a*3 is connected to the energy transmission loop of the secondary voltage Vd. For example, the balancing unit 22*a*3 is connected between the input side of the first regulating circuit 22*a* and the first rectifier and filter 22*a*4. The first rectifier and filter 22*a*4 is connected between the output side of the first regulating circuit 22*a* and the first balancing unit 22*a*3. The first current detecting circuit 22*a*2 is connected to the output side of the first regulating circuit 22*a*. The third diode D3 is connected between the first control circuit 22*a*1 and a first magnetic amplifier M1 shown in FIG. 2B. The first control circuit 22*a*1, the first current detecting circuit 22*a*2, and the third diode D3 form a first control unit.

In operation, the first control circuit 22*a*1 will obtain the current value of the first output current Io1 by the first current detecting circuit 22*a*2, and regulate the time or the power through rate for the secondary voltage Vd to transmit through the first balancing unit 22*a*3 according to the current value of the first output current Io1. Thus, the energy of the secondary voltage Vd whose duty ratio is too large will not be transmitted to the first rectifier and filter 22*a*4 through the first balancing unit 22*a*3. In this way, a first voltage Vk1 will have an appropriate duty ratio which is smaller than or equal to the duty ratio of the secondary voltage Vd, and the current value of the first output current Io1 is maintained at a predetermined value. Also, the first control circuit 22*a*1 will generate a first error signal EA1 indicative of the power through rate of the first regulating circuit 22*a* or the duty ratio of the first voltage Vk1. The first error signal EA1 will vary along with the power through rate of the first regulating circuit 22*a* or the duty ratio of the first voltage Vk1.

The second regulating circuit 22*b* includes a sixth diode D6, a second control circuit 22*b*1, a second current detecting circuit 22*b*2, a second balancing unit 22*b*3, and a second rectifier and filter 22*b*4. The third regulating circuit 22*c* includes ninth diode D9, a third control circuit 22*c*1, a third current detecting circuit 22*c*2, a third balancing unit 22*c*3, and a third rectifier and filter 22*c*4. The second control circuit 22*b*1 and the third control circuit 22*c*1 are configured to generate a second error signal EA2 indicative of the power through rate of the second regulating circuit 22*b* and a third error signal EA3 indicative of the power through rate of the third regulating circuit 22*c*, respectively.

In this embodiment, the determining circuit 23 will generate an appropriate feedback signal Vf according to the power through rate indicated by the error signals EA1-EA3, and provide the feedback signal Vf to the main control unit 24. Thus, the main control unit 24 can output a switching control signal Vpwm with an appropriate duty ratio to the main switch circuit within the front-end power supply circuit 21 (not shown). Therefore, the duty ratio of the secondary voltage Vd will not be too large or too small, thereby minimizing the power through rate of the regulating circuits 22*a*-22*c* or the duty ratio of the voltages Vk1-Vk3.

Figure 2B:
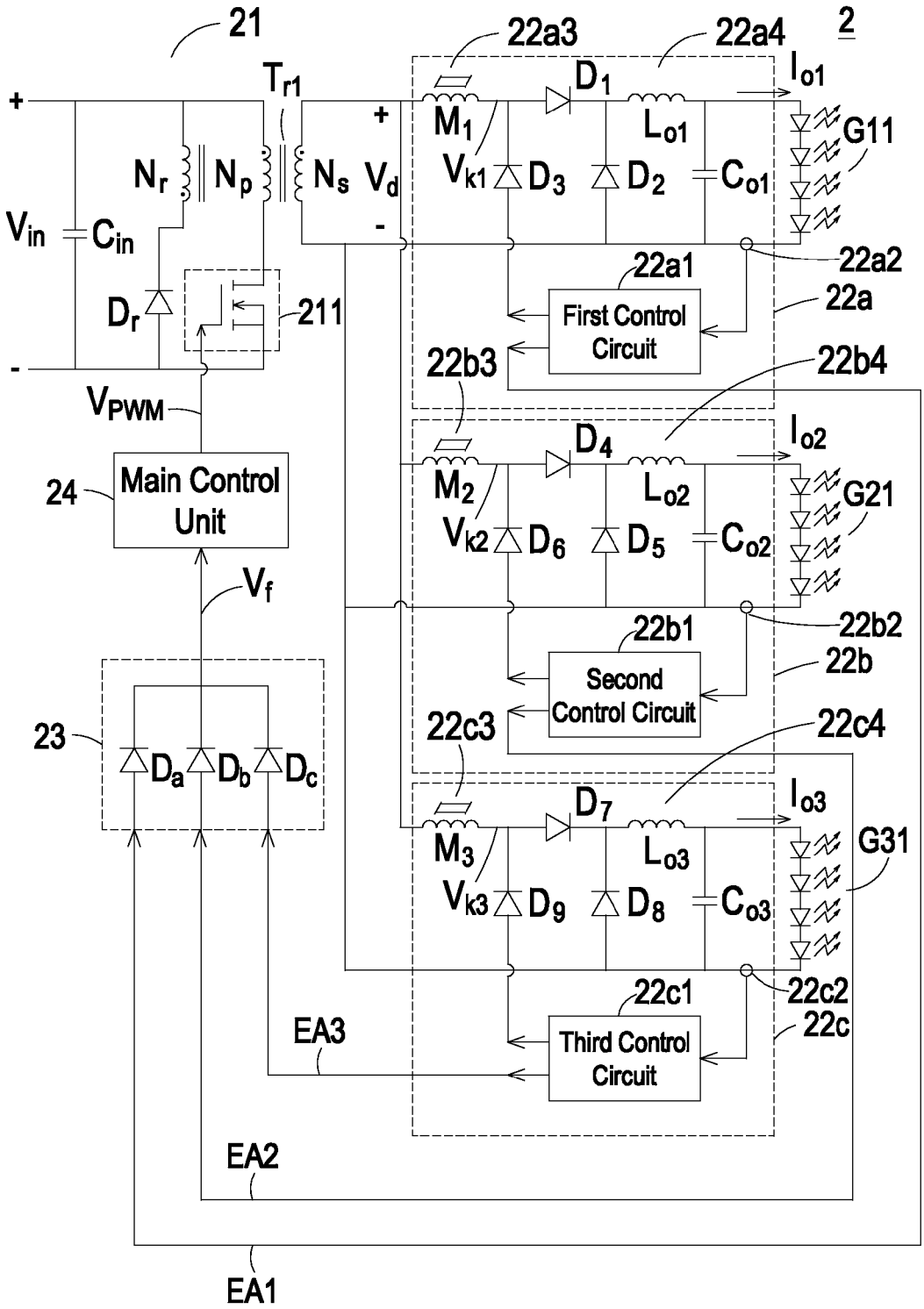
FIG. 2B shows the detailed circuitry of the multi-channel LED driver circuit according to the exemplary embodiment of the invention.

Referring to FIG. 2B and FIG. 2A, in which FIG. 2B shows the detailed circuitry of the multi-channel LED driver circuit according to the exemplary embodiment of the invention. As shown in FIG. 2B, the front-end power supply circuit 21 may be an isolated circuit, and includes a transformer Tr1 and a main switch circuit 211. The transformer Tr1 has a secondary winding Ns with a simplified structure. The primary winding Np of the transformer Tr1 is connected to the main switch circuit 211. The secondary winding Ns of the transformer Tr1 is connected to the input sides of the regulating circuits 22*a*-22*c*. The main control unit 24 is connected to the determining circuit 23 and the control terminal of the main switch circuit 211.

In operation, the main control unit 24 will control the switching operations of the main switch circuit 211. The energy of the input voltage Vin will be transmitted to the primary winding Np through the main switch circuit 211, thereby generating the secondary voltage Vd across the secondary winding Ns. The regulating circuits 22*a*-22*c* will receive the secondary voltage Vd, and the output currents Io1-Io3 provided for the light-emitting diode arrays G11-G31 can be balanced by the operations of the regulating circuits 22*a*-22*c*, thereby attaining the current-equaling performance.

In this embodiment, the first balancing unit 22*a*3 of the first regulating circuit 22*a* includes a first magnetic amplifier M1. The first rectifier and filter 22*a*4 includes a first diode D1, a second diode D2, a first filtering capacitor Co1, and a first filtering inductor Lo1. The first diode D1 and the second diode D2 form a first rectifier, and the first filtering capacitor Co1 and the first filtering inductor Lo1 form a first filter. The first magnetic amplifier M1 is connected to the energy transmission loop of the secondary voltage Vd. For example, the first magnetic amplifier M1 can be connected between the input side of the first regulating circuit 22*a* and the first rectifier. The first filter is connected between the output side of the first regulating circuit 22*a* and the first rectifier. The first current detecting circuit 22*a*2 is connected to the output side of the first regulating circuit 22*a*. The third diode D3 is connected between the first control circuit 22*a*1 and the first magnetic amplifier M1.

In operation, the first control circuit 22*a*1 will obtain the current value of the first output current Io1 by the first current detecting circuit 22*a*2 and regulate the time or the power through rate for the secondary voltage Vd to transmit through the first magnetic amplifier M1 according to the current value of the first output current Io1. Thus, the energy of the secondary voltage Vd that has an excessive duty ratio will not transmitted to the first rectifier in its entirety through the first magnetic amplifier M1, thereby adjusting the duty ratio of the first voltage Vk1 to be smaller than or equal to the duty ratio of the secondary voltage Vd and maintaining the first output current Io1 at a predetermined value. Also, the first control circuit 22*a*1 will generate a first error signal EA1 indicative of the power through rate of the first regulating circuit 22*a* or the duty ratio of the first voltage Vk1. The first error signal EA1 will be varied along with the power through rate of the first regulating circuit 22*a* or the duty ratio of the first voltage Vk1.

In this embodiment, the first error signal EA1 is positively proportional to the power through rate of the first regulating circuit 22*a* and the duty ratio of the first voltage Vk1. When the first output current Io1 exceeds the predetermined current value (the predetermined current value can be set to, for example, 50mA), the first control circuit 22*a*1 will decrease the power, time, or power through rate for the secondary voltage Vd to transmit through the first magnetic amplifier M1 to the first rectifier by controlling the blocking operation of the first magnetic amplifier M1. Thus, the power through rate of the first regulating circuit 22*a*, the duty ratio of the first voltage Vk1, and the first error signal EA1 is lowered. On the contrary, when the first output current Io1 is smaller than the predetermined current value, the first control circuit 22*a*1 will increase the power, time, or power through rate for the secondary voltage Vd to transmit through the first magnetic amplifier M1 to the first rectifier by controlling the blocking operation of the first magnetic amplifier M1. Thus, the power through rate of the first regulating circuit 22*a*, the duty ratio of the first voltage Vk1, and the first error signal EA1 is elevated.

In this embodiment, the second balancing unit 22*b*3 of the second regulating circuit 22*b* includes a second magnetic amplifier M2. The second rectifier and filter 22*b*4 includes a fourth diode D4, a fifth diode D5, a second filtering capacitor Co2, and a second filtering inductor Lo2. The fourth diode D4 and the fifth diode D5 form a second rectifier, and the second filtering capacitor Co2 and the second filtering inductor Lo2 form a second filter. The second magnetic amplifier M2 is connected to the energy transmission loop of the secondary voltage Vd. For example, the second magnetic amplifier M2 can be connected between the input side of the second regulating circuit 22*b* and the second rectifier. The second filter is connected between the output side of the second regulating circuit 22*b* and the second rectifier. The second current detecting circuit 22*b*2 is connected to the output side of the second regulating circuit 22*b*. The sixth diode D6 is connected between the second control circuit 22*b*1 and the second magnetic amplifier M2.

In this embodiment, the third balancing unit 22*c*3 of the third regulating circuit 22*c* includes a third magnetic amplifier M3. The third rectifier and filter 22*c*4 includes a seventh diode D7, an eighth diode D8, a third filtering capacitor Co3, and a third filtering inductor Lo3. The connecting relationship and the operating principle of the internal elements of the third balancing unit 22*c*3 and the third rectifier and filter 22*c*4 are similar to those of the first regulating circuit 22*a*, and it is not intended to give details herein.

Figure 3:
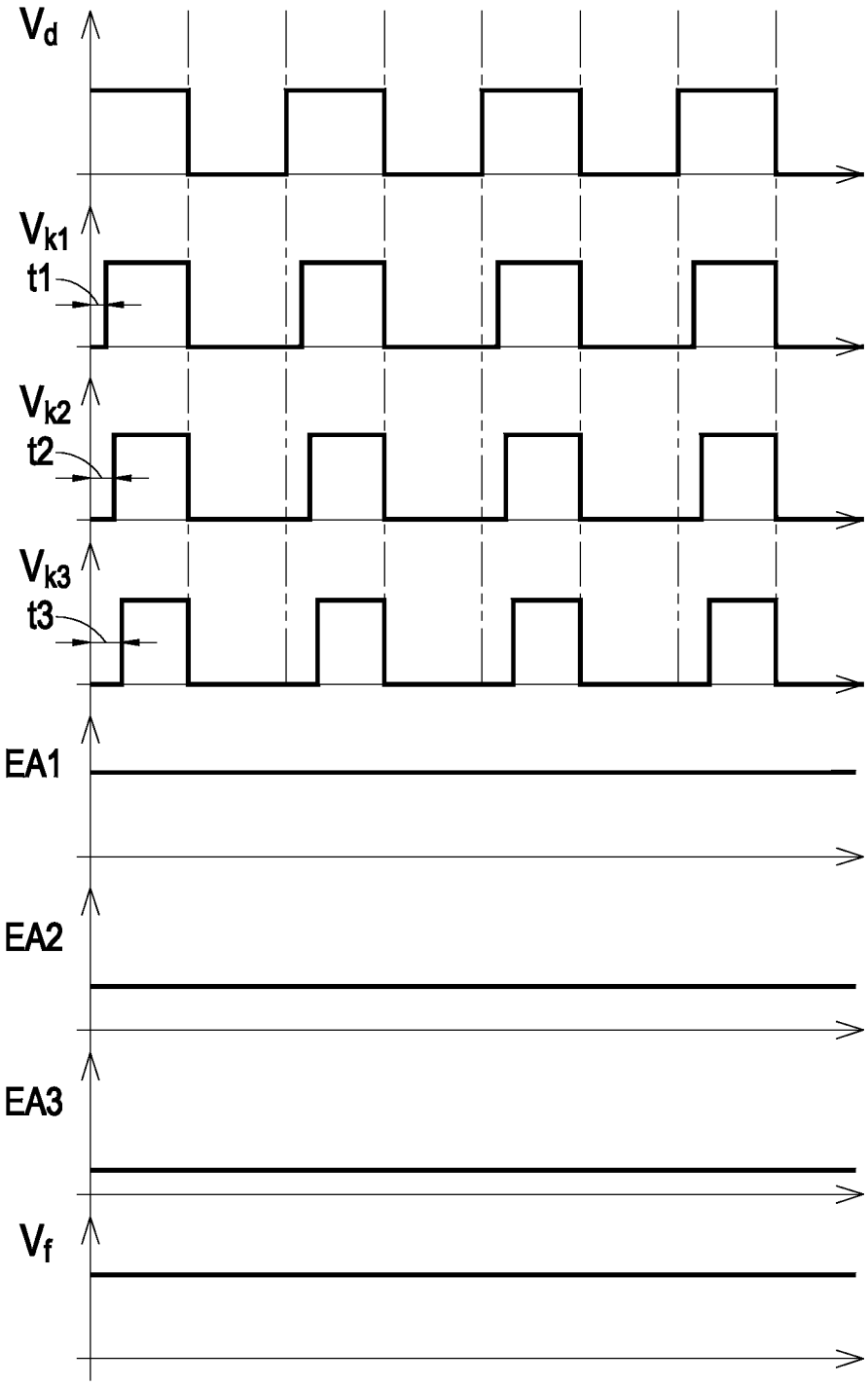
FIG. 3 shows the voltage waveforms and signal waveforms for use with the inventive multi-channel LED driver circuit.

Referring to FIGS. 2A, 2B, and FIG. 3, in which FIG. 3 shows the voltage waveforms and signal waveforms for use with the inventive multi-channel LED driver circuit. As shown in FIG. 3, as each light-emitting diode has different characteristics with each other, the regulating circuits 22*a*-22*c* that receive the same secondary voltage Vd with each other will individually regulate the duty ratios of the voltages Vk1-Vk3, the blocking periods t1-t3 of the regulating circuits 22*a*-22*c*, and the power through rate of the regulating circuits 22*a*-22*c*, such that the output currents 101-1o3 provided for the light-emitting diode arrays G11-G31 are balanced to attain the current-equaling performance.

In this embodiment, the blocking periods of the regulating circuits 22*a*-22*c* are labeled as a first blocking time t1, a second blocking time t2, and a third blocking time t3, respectively, in which t1<t2<t3. The error signals of the regulating circuits 22*a*-22*c* are labeled as a first error signal EA1, a second error signal EA2, and a third error signal EA3, respectively, in which the magnitude of the error signals are ranked as EA3<EA2<EA1. Hence, the duty ratio of the secondary voltage Vd has to be enlarged to allow the secondary winding Ns to provide enough power to the regulating circuits 22*a*-22*c*. However, if the duty ratio of the secondary voltage Vd is excessively large, the power provided by the secondary winding Ns for the regulating circuits 22*a*-22*c* will be excessive. Under this condition, the blocking periods t1-t3 will be excessive, thereby causing a high power loss to the regulating circuits 22*a*-22*c* and the multi-channel LED driver circuit 2.

To address this problem, the determining circuit 23 will generate an appropriate feedback signal Vf according to the power through rate indicated by the error signals EA1-EA3 and provide the feedback signal Vf to the main control unit 24. Thus, the main control unit 24 can generate a switching control signal Vpwm with an appropriate duty ratio and transmit the switching control signal Vpwm to the main switch circuit 211. Therefore, the duty ratio of the secondary voltage Vd will not be too large or too small, thereby minimizing the blocking periods t1-t3.

In this embodiment, the determining circuit 23 includes selection diodes Da-Dc. The cathodes of the selection diodes Da-Dc are connected to the main control unit 24, and the anodes of the selection diodes Da-Dc are individually connected to the one of the control circuits 22*a*1-22*c*1. In operation, the determining circuit 23 will select the error signal which has the highest power through rate as the feedback signal Vf. As the error signal is positively proportional to the power through rate of the regulating circuit and the error signal which has the highest power through rate is first error signal EA1, the feedback signal Vf outputted by the determining circuit 23 is the first error signal EA1.

Referring to FIG. 2B again, the front-end power supply circuit 21 in this embodiment includes an input capacitor Cin and a reset circuit consisted of a reset diode Dr. Also, the transformer Tr1 includes a reset winding Nr. The input capacitor Cin is connected to the input side of the multi-channel LED driver circuit 2 for suppressing the high-frequency noise of the input voltage Vin. The reset diode Dr and the reset winding Nr are connected with each other for resetting the energy stored in the transformer Tr1.

In conclusion, the inventive multi-channel LED driver circuit uses a transformer with a single secondary winding and a simplified structure to reduce the cost and size. Also, with the feedback signal provided by the determining circuit, the main control unit can regulating the duty ratio of the main switch circuit according to the operating status of each regulating circuit. Therefore, the duty ratio of the main switch circuit can be controlled precisely and optimistically. In this manner, the power provided by the secondary winding for the regulating circuit is appropriate. That is, the secondary voltage will have a smaller duty ratio. Furthermore, the regulating circuit and the multi-channel LED driver circuit will have a lower power loss and a higher operating efficiency.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A multi-channel light-emitting diode driver circuit for driving a plurality of light-emitting diode arrays, comprising:

a transformer having a primary winding and a secondary winding;

a main switch circuit connected to the primary winding for allowing an input voltage to be transmitted to the secondary winding and generating a secondary voltage across the secondary winding by switching operations of the main switch circuit;

a plurality of regulating circuits connected to the secondary winding and the light-emitting diode arrays for receiving the secondary voltage and providing a plurality of output currents to the light-emitting diode arrays to generate a plurality of error signals;

a determining circuit connected to the regulating circuits for receiving the error signals individually indicative of a power through rate of a regulating circuit and generating a feedback signal according to the power through rate indicated by the error signals; and a main control unit connected to a control terminal of the main switch circuit and the determining circuit for generating a switching control signal to control the switching operations of the main switch circuit.

2. The multi-channel light-emitting diode driver circuit according to claim 1 wherein the determining circuit is configured to select the error signal indicative of the highest power through rate as the feedback signal.

3. The multi-channel light-emitting diode driver circuit according to claim 2 wherein the regulating circuits are configured to receive the secondary voltage and regulate the duty ratio, the blocking period, and the power through rate of the regulating circuits individually, thereby balancing output currents of the light-emitting diode arrays and minimizing the blocking period of the regulating circuit having the highest power through rate.

4. The multi-channel light-emitting diode driver circuit according to claim 1 wherein the error signals are individually and positively proportional to the power through rate and a duty ratio of the regulating circuit.

5. The multi-channel light-emitting diode driver circuit according to claim 1 wherein the main control unit is configured to regulate a duty ratio of the switching control signal according to the feedback signal.

6. The multi-channel light-emitting diode driver circuit according to claim 1 wherein the regulating circuits comprises a first regulating circuit, which includes:

a balancing unit connected to an energy transmission loop of the secondary voltage;

a rectifier and filter connected to an output side of the first regulating circuit and the balancing unit; and a control unit connected to the balancing unit and the output side of the first regulating circuit for regulating the time or the power through rate for the secondary voltage to pass through the balancing unit according to an output current of the first regulating circuit, such that a duty ratio of a first voltage that is transmitted from the balancing circuit to the rectifier and filter is smaller than or equal to a duty ratio of the secondary voltage, thereby maintaining the output current of the first regulating circuit to a predetermined current value.

7. The multi-channel light-emitting diode driver circuit according to claim 6 wherein the rectifier and filter includes a filtering capacitor, a filtering inductor, and at least one diode.

8. The multi-channel light-emitting diode driver circuit according to claim 6 wherein the control unit includes:

a current detecting circuit connected to the output side of the first regulating circuit for detecting the output current of the first regulating circuit;

a diode connected to the balancing unit; and a control circuit connected to the diode and the current detecting circuit for obtaining the current value of the output current of the first regulating circuit by the current detecting circuit and regulating the time or the power through rate for the secondary voltage to pass through the balancing unit according to the current value of the output current of the first regulating circuit, such that the duty ratio of the first voltage that is transmitted from the balancing circuit to the rectifier and filter is smaller than or equal to the duty ratio of the secondary voltage, thereby maintaining the output current of the first regulating circuit to the predetermined current value.

9. The multi-channel light-emitting diode driver circuit according to claim 1 wherein the balancing unit comprises a magnetic amplifier.

10. The multi-channel light-emitting diode driver circuit according to claim 1 wherein the determining circuit includes a plurality of selection diodes having one end connected to the main control unit and the other end connected to the regulating circuits.

11. The multi-channel light-emitting diode driver circuit according to claim 1 further comprising a reset circuit, and the transformer further includes a reset winding connected to the reset circuit for resetting the energy stored in the transformer.

12. A multi-channel light-emitting diode driver circuit for driving a plurality of light-emitting diode arrays, comprising:

a power supply device for providing an independent voltage source; and a plurality of regulating circuits connected to the power supply device and the light light-emitting diode arrays for receiving a voltage from the voltage source and providing a plurality of output currents to the light-emitting diode arrays, and thereby generating a plurality of error signals.

13. The multi-channel light-emitting diode driver circuit according to claim 12 wherein the power supply device comprises a front-end power supply circuit for receiving an input voltage and converting the input voltage into the voltage source by switching operations of a main switch circuit in the front-end power supply circuit.

14. The multi-channel light-emitting diode driver circuit according to claim 13 wherein the front-end power supply circuit includes a transformer having a primary winding and a secondary winding, and wherein the main switch circuit is connected to the primary winding and the input voltage is transmitted to the secondary winding by switching operations of the main switch circuit, thereby generating the voltage source across the secondary winding.

15. The multi-channel light-emitting diode driver circuit according to claim 13 further comprising:

a determining circuit connected to the regulating circuits for receiving the error signals indicative of an power through rate of the regulating circuits and generating a feedback signal according to the power through rate indicated by the error signals; and a main control unit connected to a control terminal of the main switch circuit and the determining circuit for generating a switching control signal according to the feedback signal to control the switching operations of the main switch circuit according to the switching control signal.

16. The multi-channel light-emitting diode driver circuit according to claim 15 wherein the determining circuit is configured to select the error signal indicative of the highest power through rate as the feedback signal.

17. The multi-channel light-emitting diode driver circuit according to claim 16 wherein regulating circuits are configured to receive a voltage from the same voltage source and individually regulate their duty ratio, blocking period, and power through rate, thereby balancing the output currents provided to the light-emitting diode arrays and minimizing the blocking period of the regulating circuit having the highest power through rate.

18. The multi-channel light-emitting diode driver circuit according to claim 15 wherein the main control unit is configured to regulate the duty ratio of the switching control signal according to the feedback signal.

19. The multi-channel light-emitting diode driver circuit according to claim 15 wherein the voltage of the voltage source is varied along with the switching control signal.

20. The multi-channel light-emitting diode driver circuit according to claim 12 wherein the error signals are positively proportional to the power through rate and the duty ratios of the regulating circuits.

21. The multi-channel light-emitting diode driver circuit according to claim 12 wherein the regulating circuits comprises a first regulating circuit, which includes:

a balancing unit connected to an energy transmission loop of the secondary voltage;

a rectifier and filter connected to an output side of the first regulating circuit and the balancing unit; and a control unit connected to the balancing unit and the output side of the first regulating circuit for regulating the time or the power through rate for the secondary voltage to pass through the balancing unit according to an output current of the first regulating circuit, such that a duty ratio of a first voltage that is transmitted from the balancing circuit to the rectifier and filter is smaller than or equal to a duty ratio of the secondary voltage, thereby maintaining the output current of the first regulating circuit to a predetermined current value.

22. The multi-channel light-emitting diode driver circuit according to claim 21 wherein the control unit includes:

a current detecting circuit connected to the output side of the first regulating circuit for detecting the output current of the first regulating circuit;

a diode connected to the balancing unit; and a control circuit connected to the diode and the current detecting circuit for obtaining the current value of the output current of the first regulating circuit by the current detecting circuit and regulating the time or the power through rate for the secondary voltage to pass through the balancing unit according to the current value of the output current of the first regulating circuit, such that the duty ratio of the first voltage that is transmitted from the balancing circuit to the rectifier and filter is smaller than or equal to the duty ratio of the secondary voltage, thereby maintaining the output current of the first regulating circuit to the predetermined current value.

* * * * *